US009433280B2

(12) United States Patent
Hartstock

(10) Patent No.: US 9,433,280 B2
(45) Date of Patent: Sep. 6, 2016

(54) MOLDED LIP BRUSH

(75) Inventor: Karl Hartstock, Ansbach (DE)

(73) Assignee: GEKA GMBH, Bechhofen (DE)

( * ) Notice: Subject to any disclaimer, the term of this patent is extended or adjusted under 35 U.S.C. 154(b) by 335 days.

(21) Appl. No.: 13/162,999

(22) Filed: Jun. 17, 2011

(65) Prior Publication Data

US 2011/0308031 A1 Dec. 22, 2011

(30) Foreign Application Priority Data

Jun. 18, 2010 (DE) ..... 10 2010 024 236

(51) Int. Cl.

| | |
|---|---|
| ***A45D 40/26*** | (2006.01) |
| ***A46B 3/00*** | (2006.01) |
| *A45D 34/04* | (2006.01) |
| *A46B 5/00* | (2006.01) |
| *A46B 11/00* | (2006.01) |
| *A46D 1/00* | (2006.01) |

(52) U.S. Cl.

CPC ..... *A46B 3/005* (2013.01); *A46B 5/0062* (2013.01); *A45D 34/042* (2013.01); *A46B 5/0025* (2013.01); *A46B 11/00* (2013.01); *A46B 2200/1046* (2013.01); *A46D 1/0238* (2013.01)

(58) Field of Classification Search

CPC ..... A46D 40/262
USPC ..... 132/218, 318, 317, 320, 217; 15/207.2, 15/159.1, 167.3; 401/129, 9, 268
See application file for complete search history.

(56) References Cited

U.S. PATENT DOCUMENTS

| | | | | |
|---|---|---|---|---|
| 4,565,205 | A * | 1/1986 | Taylor | 132/218 |
| 5,765,573 | A * | 6/1998 | Gueret | 132/218 |
| 6,026,824 | A * | 2/2000 | Gueret | 132/218 |
| 6,053,179 | A | 4/2000 | Lhuisset | |
| 6,341,912 | B1 * | 1/2002 | Gueret | A45D 34/045 401/118 |
| 6,581,610 | B1 * | 6/2003 | Gueret | 132/218 |
| 2005/0008420 | A1 * | 1/2005 | Gueret | A45D 34/045 401/129 |
| 2006/0065282 | A1 | 3/2006 | Hartstock et al. | |
| 2007/0017544 | A1 * | 1/2007 | Gueret | A45D 40/267 132/320 |
| 2008/0053474 | A2 * | 3/2008 | Castagno et al. | 132/320 |
| 2009/0214284 | A1 * | 8/2009 | Gueret | 401/121 |

FOREIGN PATENT DOCUMENTS

| | | | |
|---|---|---|---|
| DE | 69824058 | T2 | 6/2005 |
| EP | 1645204 | A1 | 4/2006 |
| GB | 2159699 | * | 12/1985 |
| WO | 0156894 | A2 | 8/2001 |
| WO | 2007078769 | A2 | 7/2007 |

* cited by examiner

*Primary Examiner* — Todd E Manahan
*Assistant Examiner* — Brianne Kalach

(57) ABSTRACT

The invention relates to a cosmetic brush having a handle with the longitudinal axis LH and having a brush applicator adjoining the handle; the brush applicator is composed of a bending element that is flexible in at least one plane, has a longitudinal axis LS, and has a set of bristles composed of a plurality of bristles that are integrally injection-molded onto its distal end, whose longitudinal axes LB extend (entirely or essentially) parallel to the longitudinal axis LS.

11 Claims, 4 Drawing Sheets

LS
LH
DE
PE

MOLDED LIP BRUSH

FIELD OF THE INVENTION

The invention relates to a cosmetic brush and preferably a brush for applying a lip cosmetic.

BACKGROUND OF THE INVENTION

The "prior art" drawing shows a brush applicator of a kind known from the prior art, intended for use as a cosmetic brush. Such a brush is composed of a bundle of hair or bristles that is long, more or less, and is secured in a holder element.

A wide variety of cosmetic brushes are known from the prior art. They are used not only for applying powder, but often also for applying viscous cosmetics, i.e. ones that run the gamut from liquid to paste-like or gel-like, such as lip gloss.

Depending on the intended use, such brush applicators have a densely packed number of fine, relatively long bristles. In the context of this description, the term "bristles" is understood to broadly refer to any fiber-like structure suitable for producing a brush. These bristles are very flexible in the region of their distal ends. But below approximately the last distal quarter of their length in the proximal direction, they rest against one another more and more. Both when the brush is new and when it is influenced by the cosmetic, which tends to make the bristles stick to one another, the bristles form a kind of "block" that is significantly more rigid than the individual, fine bristles in the region of their distal ends. This gives a brush with a set of long, fine bristles its typical application properties, namely a soft brush tip, but a set of bristles that is nevertheless not overly flexible.

With prolonged use, even with careful selection of materials, a swelling of the bristle material can occur, which causes the brush as a whole to swell, thus negatively affecting its shape and application properties.

Also, especially in brushes composed of long, fine bristles, it is almost inevitable that when the brush is reinserted through the narrow neck of the bottle or stripping device, individual bristles get caught on the sides and as a result, become permanently bent so that they stick out to the side afterward. Even if individual bristles do not buckle completely, in brushes composed of long, fine bristles there is always the risk that over time, a certain "umbrella effect," namely a certain splaying of the set of bristles, will occur.

Finally, brushes with a set of densely packed, relatively long, fine bristles are also not without problems because there is always a risk that in the region a certain distance from the distal ends of the fibers, bacteria will collect and multiply "on the inside," so to speak, of the set of fibers constituting the brush.

To remedy this problem, numerous suggestions have been made to replace the brush-like part with a "monolithic" body composed of a flexible plastic or elastomer material, whose outer contour has roughly the same outer contour as a brush. In such an approach, a plastic body with a smooth, intrinsically closed surface is first flocked to improve its product storage capacity. A "brush applicator" produced in this way does in fact keep its shape very well, but does not really have a satisfactory product storage capacity. Also, the tip of such a brush applicator is significantly harder than the tip of a brush applicator composed of a number of fine, relatively long bristles.

Finally, the customary brush applicators are relatively expensive to manufacture.

In light of this situation, the object of the invention is to create a brush applicator that is dimensionally stable over the long term, offers a good product storage capacity, and has a tip region that permits a precisely contoured application.

SUMMARY OF THE INVENTION

This object is attained by a cosmetic brush as described herein. Such a cosmetic brush is composed of a handle with the longitudinal axis LH and a brush applicator adjoining the handle. In addition to a fastening section for coupling to the handle, the brush applicator also has a generally one-piece flexible bending element with a longitudinal axis LS. The longitudinal axis in this case is the axis extending in the direction of the greatest length of the brush applicator and generally corresponds to the longitudinal axis of the handle to which the brush applicator is normally coupled. The bending element has a set of bristles composed of a plurality of bristles that are integrally injection-molded onto its distal end, preferably using 1 K technology, possibly also using 2 K technology, whose longitudinal axes LB extend parallel to the longitudinal axis LS. In the context of the invention, they are considered to be parallel if the longitudinal axis LB of the bristles encloses an angle of ≤20° and preferably ≤12.5° with the longitudinal axis LS. Ideally, they are completely parallel aside from tolerance-dictated deviations of ≤5°. To achieve the application properties of a conventional brush, the set of bristles is preferably embodied so that when new, it contains no non-parallel bristles, i.e. no bristles that protrude undesirably to the side. Normally, the longitudinal axis LS of the bending element is also aligned with the longitudinal axis LH of the handle, which is usually embodied in the shape of a brush handle.

Preferably, plastics of the type marketed under the brand names Hytrel® or Grilflex® or plastics of similar qualities are used as the materials for the bending element and preferably also for the bristles. Hytrel® is a trademark of the DuPont company for thermoplastic polyester elastomers. These polyester elastomer block copolymers combine many of the best properties of high performance elastomers and flexible plastics. Grilflex® is a trademark of the EMS-GRIVORY company and stands for polyamide high performance elastomers from the PEBA group.

Because of its function, the bending element can also be referred to as a so-called "bristle replacement element"—if the brush applicator according to the invention is compared to conventional brushes, such as those that have a relatively long set of bristles with a freely extending bristle length of ≥16 mm, then it is clear that the part of the bristles that does not perform any direct function during the application (and in particular, the application of a lip cosmetic) has been replaced by the generally monolithic bending element. The bending element here is embodied as elastic so that it has a flexibility in at least one plane, which is comparable to the flexibility that the whole group of bristle shafts have in the region in which the bending element replaces these bristle shafts. When subjected to the forces that occur during proper application, the bending element thus has, in at least one plane, a flexibility that is visible to the naked eye and is also tactilely perceptible by the region of skin being treated. Preferably, the bending element is embodied so that when subjected to the forces that occur during proper application, the longitudinal axis LS of its distal end, which serves as an anchoring region for the set of bristles, can be deflected by at least 0.75 mm and even better by at least 1 mm or even 1.5 mm orthogonally away from the position that the longitudinal axis LS assumes in the unstressed state. The bending element is nevertheless more rigid, preferably by a factor of at least 10, than an individual injection-molded bristle. As a rule, the bending element is integrally embodied, i.e. as a one-piece plastic block, only one of which is provided in each brush applicator. To circumvent the scope of protection claimed by the wording from a patent law standpoint, it would also be conceivable in principle to provide two or three such bending elements per brush applicator. Such a circumventing embodiment, however, will not be selected without a compelling reason.

The invention is based on the knowledge that even in a conventional brush of the above-mentioned kind—especially when used for applying a lip cosmetic—the application properties are chiefly influenced by the brush tip, while up to 75% of the free brush length is used only to achieve the necessary flexibility. Particularly in lip brushes, hardly any product is stored in the deep part between the fibers.

The novel concept of the invention makes use of this knowledge: the part of the various bristle shafts that does not perform any essential, direct function during the application (aside from assuring the flexibility) is replaced by the monolithic bending element. At its distal end, the bending element is provided with a set of short bristles. The bending element in this case is embodied as flexible enough that the flexibility required for the desired application properties is assured at the brush tip that the set of bristles provides.

The length of the bristles is preferably ≤8 mm and ideally ≤6 mm. The maximum bristle diameter is preferably ≤0.075 mm and ideally ≤0.05 mm or even only 0.04 mm.

The bristles are normally equipped with a circular cross section, but this can also be replaced with a polygonal cross section. Triangular or rectangular cross sections are also possible. Preferably, the bristles taper towards their distal ends.

Because the shafts of the bristles only have to constitute a fraction of the free length of the brush applicator ("decoupling of bristle diameter and bending elasticity of the brush applicator"), the bristles can in many cases be finer than conventional bristles for brushes with relatively long bristles.

A brush applicator of this kind offers significant advantages. The comparatively short set of bristles is relatively rugged and is largely spared from the immediate buckling of individual bristles or the so-called umbrella effect, despite the fact that the individual bristles are very fine. For this very reason, the brush applicator according to the invention is perfectly suited to being manufactured by injection molding, though it is still not easy to use injection molding to manufacture bristles that are comparable to brushes composed of high-quality extruded filaments in terms of their ability to stand back up again and their resistance to buckling. The short set of bristles is also much less susceptible to contamination with germs because the bending element can be stripped much better and has much less area available for colonization than the plurality of parallel, densely packed bristle shafts that it replaces.

Preferably, the cosmetic brush is embodied so that the bending element has at least one weakening feature that reduces its rigidity.

Such a weakening feature can be embodied in various forms, namely in the form of transverse notches, for example, which selectively reduce the rigidity, or in the form of at least one opening, which partly divides the bending element into two or more separate arms, which rejoin in the distal region and whose thickness determines the rigidity. Such a weakening feature is advantageous because it makes it possible for the bending element as a whole—and therefore also its distal end—to be embodied as wider and also makes it possible to enlarge the available area for attaching the set of bristles, without simultaneously reducing the flexibility.

Preferably, the cosmetic brush is designed so that the bending element is embodied in the form of a tongue that is flexible in one plane.

Preferably, the tongue has an essentially rectangular cross section; the first side length of the rectangular cross section is longer than the perpendicular second side length of the rectangular cross section by a factor of 2, ideally by even more than a factor of 2.5. This ensures that the bending element has the desired flexibility in one plane, while in the plane perpendicular to this, it is significantly more rigid, preferably at least 4 times more rigid, and thus when stroked across the region of skin being treated, offers good lateral guidance similar to that of a flat brush. It is also advantageous if the cross section of the tongue decreases by more than 10% and preferably by more than 20% from the proximal end of the tongue to the distal end of the tongue so that the flexibility of the bending element increases towards the distal end.

Preferably, the cosmetic brush is designed so that the bending element is embodied in the form of a flat spatula that has two essentially flat main spatula surfaces facing in opposite directions on both sides of the longitudinal axis LS of the spatula.

A considerable quantity of the cosmetic can be stored by adhering to the comparatively large surface of the main spatula surfaces, which can also be used to selectively withdraw the desired larger quantity of cosmetic from the storage receptacle. They therefore permit an efficient, broad-coverage application of the cosmetic onto the region of skin being treated. This has a very positive effect because the bending element constituting the flat spatula is elastic so that in response to the bending that it is compelled to execute, the main spatula surface involved can favorably conform to the contours of the region of skin being treated. The brush-like set of bristles on the spatula is used for sensitively drawing fine boundaries, for example the lip contour. This additional embodiment type therefore yields a 2-in-1-applicator, i.e. an applicator that combines the advantages of the different application rates of a brush and a spatula.

Preferably, the cosmetic brush is embodied so that the two main spatula surfaces account for more than 50% and preferably more than 70% of the surface of the spatula. The bristle surface does not count as part of the spatula surface in this context.

Preferably, the cosmetic brush is embodied so that the main spatula surface is bristle-free.

A bristle-free embodiment favorably strengthens the main spatula surface for a broad-coverage application. Ideally, the main spatula surface is completely smooth; a flocking can also be alternatively provided.

Preferably, the cosmetic brush is embodied so that the outer contour of the bending element makes an essentially smooth transition into the outer contour of the bristle field. A transition is considered to be essentially smooth if there is a difference of ≤4 times the maximum bristle diameter and preferably ≤2 times the maximum bristle diameter between the transverse extension (i.e. the extension perpendicular to the longitudinal axis LS) of the outer contour of the bending element and the transverse extension of the outer contour of the bristle field, directly at the transition between the bending element and bristle field.

Preferably, the cosmetic brush is embodied so that the distal end surface of the spatula to which the bristles are anchored is embodied in the form of an arc that extends from one narrow end of the spatula to the other narrow end of the spatula. This arc is preferably embodied in the form of a semicircular arch, i.e. its curvature essentially corresponds to a circular arc. Alternatively, however, it is also possible to provide a curvature that is convex in some other way. Such an arc makes it possible to use bristles that are essentially all the same length to construct a tongue-shaped, so-called "pointed" or even round-tipped bristle field, which is particularly advantageous since both the broad side and the narrow side of a brush embodied in this way can be used to draw a fine boundary line. The bristles are advantageously injection molded only within the area constituted by the arc.

Preferably, the cosmetic brush is embodied so that at least one of the main spatula surfaces is provided with a profiling in at least some regions and the profiling is preferably composed of a number of ribs extending in the longitudinal direction. Such a profiling increases the product storage capacity of the involved main spatula surface. If the profiling is not too deep, it does not negatively affect the suitability of this main spatula surface for executing a broad-coverage application. The profiling is logically selected so that the profile depth does not exceed three times, or better still two times, the maximum bristle diameter. The profile depth is understood here to mean the distance between the highest point and the immediately adjacent lowest point of the profiling, measured perpendicular to the longitudinal axis LS of the spatula.

Preferably, the cosmetic brush is embodied so that the ribs are each aligned with the bristles closest to them and the hollows between the ribs feed into the gaps between the closest bristles.

The hollows therefore constitute "conduits" of a sort for supplying the bristles with the cosmetic that initially adheres to the main spatula surface.

Preferably, the cosmetic brush is embodied so that the proximal end of the spatula transitions into a hilt that is adjoined by a coupling section for fastening the spatula to the handle.

Preferably, the cosmetic brush is embodied so that the bristle field is a flat bristle field whose bristle count in a first direction is at least 2.5 times greater, or better still at least 3 times greater, than its bristle count in a second direction perpendicular to the first direction.

Preferably, the cosmetic brush is embodied so that the length of the bending element in the direction of the longitudinal axis LS is greater than the length of the bristles by a factor of at least 4.

Other advantages, functions, effects, and possible embodiments ensue from the following, exemplary embodiments described in conjunction with the figures.

DETAILED DESCRIPTION OF THE PREFERRED EMBODIMENTS

Figures 1A, 1B, 1C, 1D:
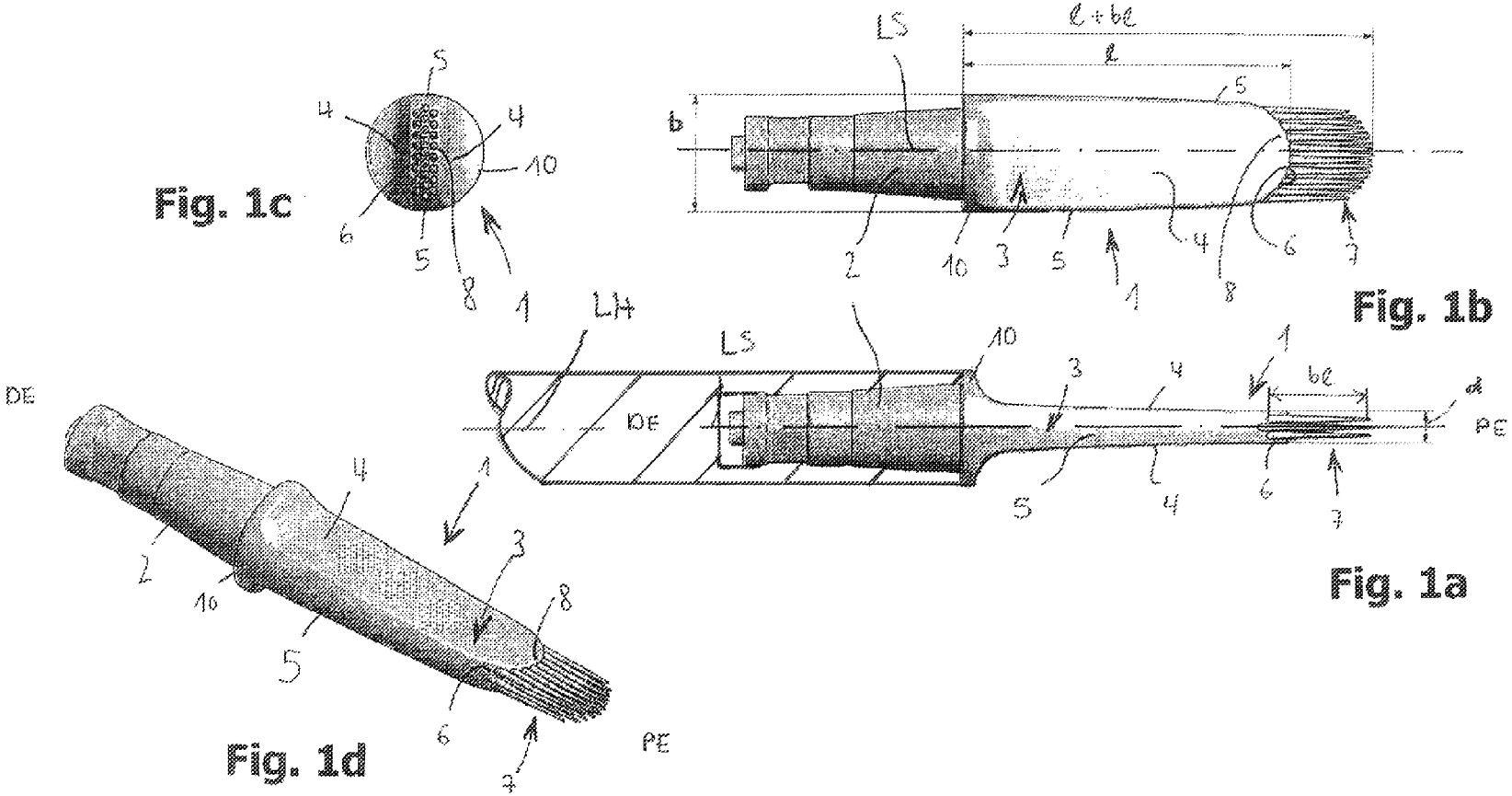
FIGS. 1*a* through 1*d* show a first exemplary embodiment of the invention in which the flexible bending element is composed of a spatula with a completely smooth, intrinsically closed surface.

The brush applicator is composed of a fastening section 2 for connecting to the handle, not shown here except in FIG. 1*a*, which has a central axis LH and will be chiefly embodied in the form of an elongated narrow shaft of the kind also used in other brushes. The brush applicator 1 has another section, the so-called flexible bending element 3, which replaces a portion of the length that is otherwise occupied by the shafts of the bristles. Although not necessarily a requirement for the invention according to claim 1, in the exemplary embodiments, the flexible bending element 3 constitutes a spatula, which will be explained in greater detail below and thus for the sake of simplicity, is referred to in many places below only as the "spatula 3"—although to be completely correct, it would actually have to be referred to as "the flexible bending element 3 in the form of a spatula".

The brush applicator 1 and its spatula 3 have a longitudinal axis LS. As a rule, this axis corresponds to the longitudinal axis LH of the shaft, which serves as a handle and to which the applicator element 1 is attached with the aid of a fastening section 2.

In this exemplary embodiment, the spatula 3 is embodied in the form of a flat spatula. It has two essentially flat main spatula surfaces 4 facing in opposite directions, which constitute the applicator surface of the spatula. The main spatula surfaces—viewed in the direction of the longitudinal axis LS—are preferably between 0.8 cm and 2.2 cm long (length 1) and perpendicular to this, are preferably between 0.25 cm and 0.75 cm wide (width b). The thickness of the spatula perpendicular to a main spatula surface is between 0.12 cm and 0.7 cm (thickness d); the thickness preferably decreases toward the distal end. The spatula is preferably made of an elastic plastic and embodied so that when bent, its tip can be moved by at least 0.8 mm perpendicular to the longitudinal axis LS without permanent material deformation or overloading of the spatula. This yields a spatula that optimally follows contours when subjected to the forces that usually occur during application.

The main spatula surfaces 4 are coated with a layer of the cosmetic by dipping them into the cosmetic. Each of these main spatula surfaces 4 is embodied and positioned so that it can be drawn along the region of skin to be treated with the cosmetic and as a result, applies the cosmetic adhering to it onto the region of skin to be treated. The spatula is embodied so that its main spatula surfaces account for more than 50%, ideally more than 75%, of the wettable surface of the actual spatula (not including of the bristle surface).

The main spatula surfaces extend essentially parallel to the longitudinal axis LS of the spatula. Their inclination relative to the longitudinal axis LS of the spatula is therefore described by the relation $0° \leq \text{inclination} \leq 15°$. Ideally, the inclination of at least one of the main spatula surfaces is described by the relation $2° \leq \text{inclination} \leq 5°$.

Figure 2B:
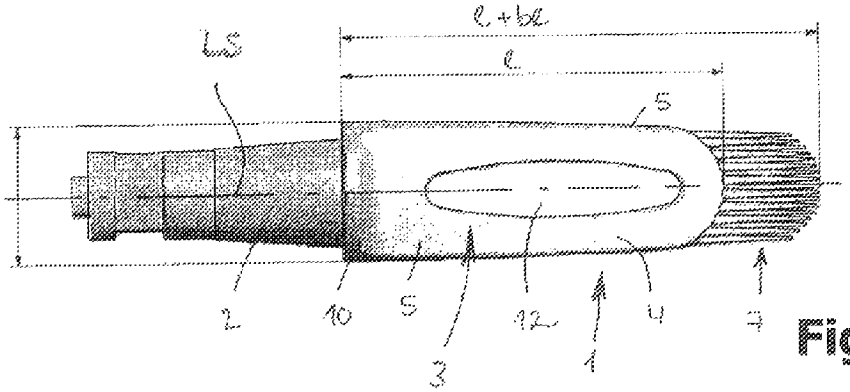
FIGS. 2*a* through 2*d* show a second exemplary embodiment in which the flexible bending element is provided with an opening in the middle, which increases its flexibility without requiring a reduction in its width.
Figure 2A:
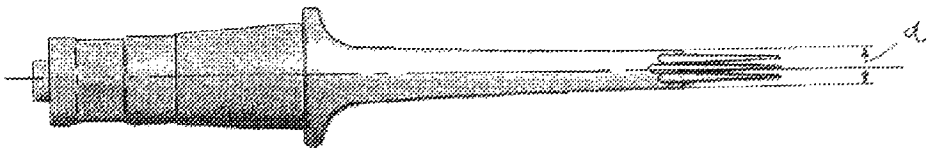
Figure 2C:
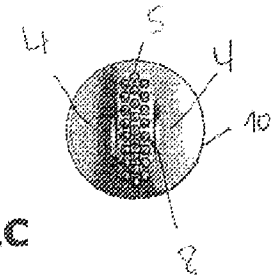
Figure 2D:
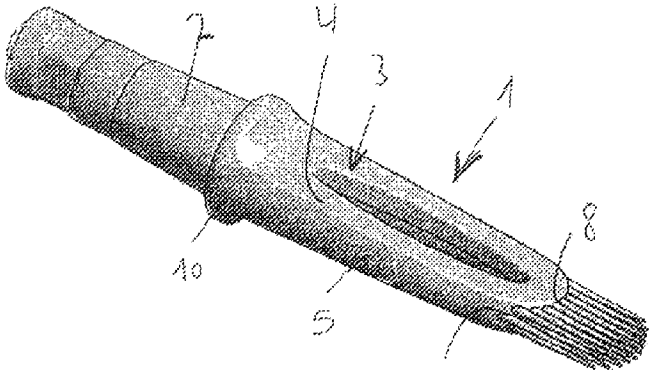

At least one main spatula surface, generally all of them, or even the entire spatula except for its distal end, is bristle-free, i.e. it is not embodied with protrusions, between which there are surface regions of the main spatula surface to which the cosmetic can adhere in such a way that with proper use of the spatula, the cosmetic does not come into direct contact with the region of skin being treated. In this first exemplary embodiment (as shown in FIGS. 2*a* through 2*c*) the main spatula surfaces or the applicator surfaces of the spatula actually have a completely smooth surface, which has the usual surface roughness only in the microscopic range. Such a bristle-free applicator surface is very well-suited to a broad-coverage application of the cosmetic. If necessary, however, the applicator surface can also be flocked; as a rule, the flocking is embodied as fine so as to increase its suitability for a broad-coverage application of the cosmetic. If necessary, at least one of the main spatula surfaces can have a fine structuring that improves the abundant adhesion of the cosmetic and corresponds to the above definition, i.e. is not too coarse, and which as a variant, is shown by way of example in FIG. 1*d* in the form of a localized pattern of minute pyramids.

The spatula also has two narrow surfaces 5 likewise facing in opposite directions and an end surface 6 at its distal end oriented away from the handle. The end surface 6 connects the two narrow surfaces 5. At the proximal end, the two main spatula surfaces 4 and narrow surfaces 5 end at a circumferential hilt 10, which is provided not only for supporting purposes, but also—by means of its edge surfaces 11 that adjoin the main spatula surfaces and rise by more than 1.25 mm perpendicular to the longitudinal axis in doing so—serves to prevent the load of cosmetic on the main spatula surfaces from being prematurely pushed away toward the handle in the direction of the longitudinal axis L during application instead of being drawn onto the region of skin to be treated.

The main spatula surfaces are significantly narrower in the region of the distal end and therefore provide a region that can be used to apply the cosmetic with greater selectivity onto the border between region of skin to be treated and a region of skin that is not to be treated. In the exemplary embodiment discussed here, this is achieved by the fact that the end surface 6 is convexly curved—preferably continuously—in the direction from one narrow surface to the other narrow surface. As a result, each of the main spatula surfaces has an arc-shaped edge 8 at its distal end that transitions into the straight lateral edges 9. The main spatula surfaces 4 therefore become narrower toward their distal ends in a "tongue-like" fashion. This arc-shaped edge makes it possible to embody the bristle field, which will be described in greater detail immediately below, out of a number of bristles that are essentially the same length as one another and thus at least similarly flexible while still giving the bristle field an arc-shaped outer contour at its distal end—preferably an outer contour at which the "tongue-like tapering" of the main spatula surfaces reverses again.

The end surface 6 supports a set of bristles 7 that are injection molded onto the spatula. The bristles are preferably each conical in shape. The bristle field extends essentially over the entire width b of the main spatula surfaces 4 at their distal ends, i.e. at the transition to the bristle field. The bristle field is preferably embodied with multiple rows and is composed of at least two or better still, from three to five, side-by-side rows of 6 to 18 bristles each, arrayed in a line. Preferably, adjacent bristle rows are embodied with a repeating pattern, which is selected so that a bristle of a first row is centered at the position of the bristle gap between two bristles of the adjacent row. The length 1 of the bristles is preferably between 2.5 mm and 7.5 mm and the maximum bristle diameter is preferably between 0.15 mm and 0.45 mm (measured in the undisturbed bristle region, i.e. outside any sharply rounded or throat-shaped region possibly provided at the base of the bristle).

The length of the bristles is preferably selected so that the outermost distal edge of the bristle field extends in the shape of an arc and is curved convexly outward.

At least one bristle row situated in the middle region, i.e. one that is surrounded on two sides by an adjacent bristle row, is preferably composed of bristles that are 0.3 mm to 0.9 mm longer than the two immediately adjacent bristle rows so that the bristle ends of the above-mentioned bristle row situated in the middle region protrude beyond the rest of the bristle ends of the bristle field (not shown in FIG. 2). This produces a bristle field that on the one hand, provides increased storage capacity for the cosmetic and whose bristles effectively rest against one another in their base region, but on the other hand, offers the possibility of drawing a very fine line, by bringing only the tips of the bristle field into contact with the region of skin to be treated.

The bristle geometry and the plastic from which the bristles are produced are preferably matched to each other so that when subjected to the forces that occur during application, the center line of the bristle ends can be repeatedly bent into a position that is inclined by at least 60° relative to the longitudinal axis LS, without the bristles losing the ability to return to their undisturbed starting position.

FIGS. 2*a* through 2*c* show a second exemplary embodiment of the applicator element 1 according to the invention. The second exemplary embodiment corresponds precisely in design to the first exemplary embodiment, so that everything that has been described above for the first exemplary embodiment is also fully applicable to the second exemplary embodiment.

This second exemplary embodiment differs from the first only as follows:

In this second exemplary embodiment, the spatula 3 is provided with an opening 12 that extends through both main spatula surfaces 4. The main spatula surfaces 4 therefore both have a "hole" that extends all the way through the spatula. Preferably, the opening 12 has an elongated inner cross section, i.e. a cross section whose maximum length in the direction of the longitudinal axis L is at least three times greater than in the direction perpendicular to this. In this second exemplary embodiment, the opening has a cigar-shaped inner cross section. When the spatula is withdrawn from the cosmetic storage receptacle, this opening retains a significant quantity of cosmetic product and thus constitutes a reservoir for the cosmetic product. The inner cross section of the opening and the flexibility of the spatula are matched to the rheology of the cosmetic product that is to be applied with the spatula so that the cosmetic product stored in the opening is pushed out from the opening and dispensed again, particularly at the moment in which the spatula deforms as intended in the course of the application.

Figure 3B:
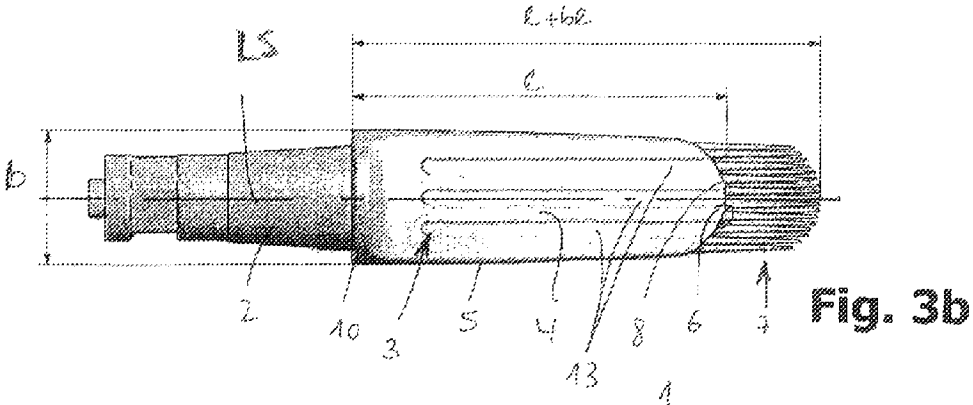
FIGS. 3*a* through 3*d* show a third exemplary embodiment with a first alternative for a profiling of the flexible bending element.
Figure 3A:
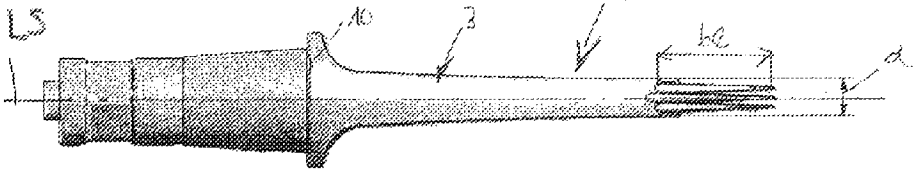
Figure 3C:
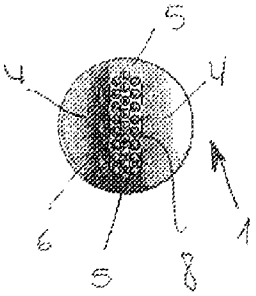
Figure 3D:
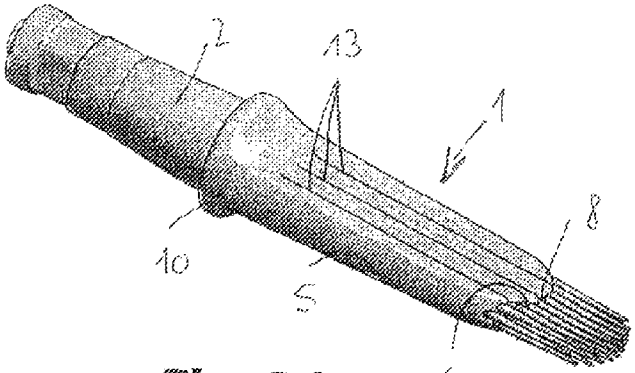

FIGS. 3*a* through 3*c* show a third exemplary embodiment of the applicator element 1 according to the invention. The third exemplary embodiment corresponds precisely in design to the first exemplary embodiment, so that everything that has been described above for the first exemplary embodiment is also fully applicable to the third exemplary embodiment.

This third exemplary embodiment differs from the first only as follows:

In this third exemplary embodiment, the main spatula surfaces 4 do not have a completely smooth surface, but instead have a profiling that promotes the adhesion of the cosmetic to the main spatula surface 4, thus forming a kind of reservoir. The profiling is preferably embodied in the form of a plurality of channels 13 whose respective central axes each extend in the direction of the longitudinal axis LS, possibly at the same slight inclination that the main spatula surfaces 4 themselves have relative to the longitudinal axis LS. Preferably 2 to 10 channels are provided. The channels preferably have a slight depth compared to the remaining unprofiled portion of the main spatula surface, which ranges from 0.75 to 3 times the maximum bristle diameter. The width of the channels preferably ranges from 1 to 3 times the maximum bristle diameter. In FIG. 3, the width is approximately 1.5 times the maximum bristle diameter. Ideally, the channels intersect with the distal edge of the respective main spatula surface and are thus open toward the bristle field. This promotes the dispensing of the cosmetic, which is temporarily stored in the channels, in the course of the application.

In the third exemplary embodiment, three parallel channels are provided, whose respective depth is less than the maximum bristle diameter and whose width is more than one and less than two times the maximum bristle diameter.

Figure 4B:
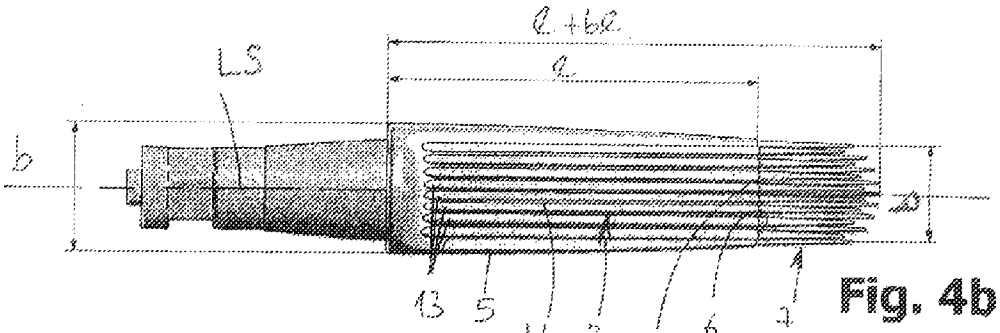
FIGS. 4*a* through 4*d* show a fourth exemplary embodiment with a second alternative for a profiling of the flexible bending element.
Figure 4A:
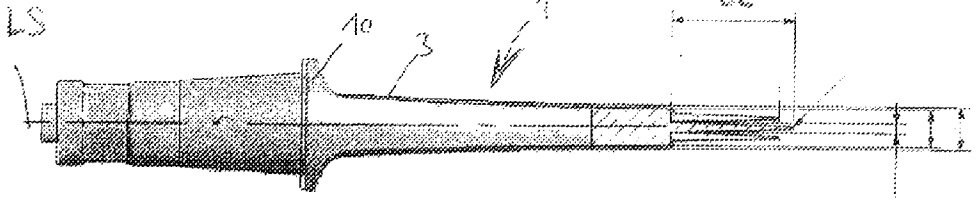
Figure 4C:
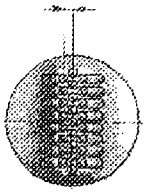
Figure 4D:
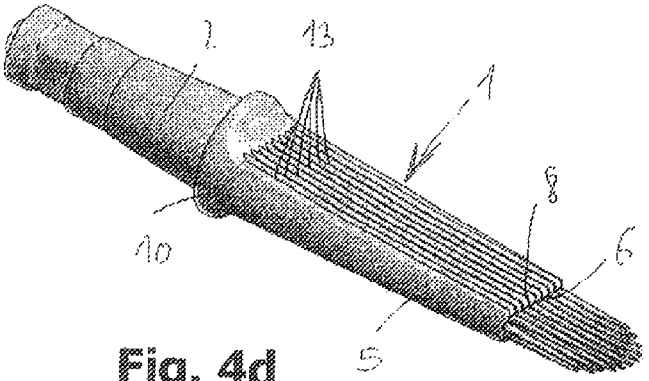

FIGS. 4*a* through 4*c* show a fourth exemplary embodiment of the applicator element 1 according to the invention. The fourth exemplary embodiment corresponds precisely in design to the first and third exemplary embodiments simultaneously, so that everything that has been described above for them is also fully applicable to the fourth exemplary embodiment.

This fourth exemplary embodiment differs from the first and third exemplary embodiments only as follows:

Eight parallel channels 13 are provided in the fourth exemplary embodiment. Their respective depth is less than the maximum bristle diameter. The respective width of the channels corresponds to the maximum bristle diameter. Each of the channels is aligned with the bristle closest to it so that the cosmetic stored in the channels, as it leaves each channel, is conveyed directly to the bristle adjoining it in the distal direction.

In addition, in the exemplary embodiment shown in FIG. 4, the end surface 6 is straight, which requires a field composed of bristles of different lengths in order to achieve a rounded brush tip.

The invention claimed is:

1. A cosmetic brush having a handle with a longitudinal axis LH and having a brush applicator adjoining the handle, wherein the brush applicator comprises:

a bending element that is flexible in at least one plane and has a tongue form with a cross-sectional area that decreases by more than 10% from a proximal end of the tongue to a distal end of the tongue resulting in increased flexibility towards the distal end, wherein the bending element has a longitudinal axis (LS); and a set of bristles composed of a plurality of bristles that are integrally injection-molded onto a distal end of the bending element, wherein the set of bristles comprises at least two rows of bristles along a lateral axis of the bending element, longitudinal axes (LB) of the bristles extend entirely parallel to the longitudinal axis (LS) of the bending element, and an outer contour of the bending element makes an essentially smooth transition into an outer contour of the set of bristles, with the essentially smooth transition being determined by a difference of ≤2 times a maximum bristle diameter between a transverse extension of the outer contour of the bending element and a transverse extension of the outer contour of the set of bristles, directly at a transition between the bending element and the set of bristles, and wherein a length of the bending element in the direction of the longitudinal axis (LS) is greater than a length of the bristles by a factor of at least 4.

2. The cosmetic brush as recited in claim 1, wherein the bending element has at least one weakening feature that reduces its rigidity, and the weakening feature is selected from the group consisting of transverse notches on the bending element, and at least one opening, which partly divides the bending element into two or more separate arms, which rejoin in the distal region.

3. The cosmetic brush as recited in claim 1, wherein the bending element is embodied in the form of a tongue that is flexible in one plane.

4. The cosmetic brush as recited in claim 1, wherein the bending element is embodied in the form of a flat spatula that has two essentially flat main spatula surfaces facing in opposite directions on both sides of a longitudinal axis of the spatula.

5. The cosmetic brush as recited in claim 4, wherein the two main spatula surfaces account for more than 50% of the surface of the spatula, not including any bristle surface as part of the surface of the spatula.

6. The cosmetic brush as recited in claim 4, wherein the main spatula surfaces are bristle-free.

7. The cosmetic brush as recited in claim 4, wherein at least one of the main spatula surfaces is provided with a profiling in at least some regions and the profiling comprises a plurality of ribs extending in the longitudinal direction.

8. The cosmetic brush as recited in claim 7, wherein the ribs are each aligned with the bristles closest to them so that hollows between the ribs feed into gaps between the closest bristles.

9. The cosmetic brush as recited in claim 1, wherein a distal end surface of the spatula to which the bristles are anchored is embodied in the form of an arc that extends from one narrow side of the spatula to an opposite narrow side of the spatula.

10. The cosmetic brush as recited in claim 1, wherein a proximal end of the spatula transitions into a hilt that is adjoined by a fastening section for fastening the spatula to the handle.

11. The cosmetic brush as recited in claim 1, wherein the set of bristles comprises a flat bristle field whose bristle count in a first direction is at least 2.5 times greater than its bristle count in a second direction perpendicular to the first direction.

* * * * *